US007766085B2

(12) United States Patent
Stephenson et al.

(10) Patent No.: US 7,766,085 B2
(45) Date of Patent: Aug. 3, 2010

(54) APPARATUS, ASSEMBLY AND PROCESS FOR INJECTING FLUID INTO A SUBTERRANEAN WELL

(75) Inventors: Pearl E. Stephenson, Houston, TX (US); William D. Holmes, Burton, TX (US)

(73) Assignee: Marathon Oil Company, Houston, TX (US)

( * ) Notice: Subject to any disclaimer, the term of this patent is extended or adjusted under 35 U.S.C. 154(b) by 51 days.

(21) Appl. No.: 12/025,465

(22) Filed: Feb. 4, 2008

(65) Prior Publication Data

US 2009/0194293 A1 Aug. 6, 2009

(51) Int. Cl.
*E21B 43/00* (2006.01)
*E21B 23/03* (2006.01)

(52) U.S. Cl. ..... 166/372; 166/377; 166/387

(58) Field of Classification Search ..... 166/372, 166/377

See application file for complete search history.

(56) References Cited

U.S. PATENT DOCUMENTS

| | | | | |
|---|---|---|---|---|
| 1,067,868 | A | | 7/1913 | Dunn |
| 1,754,945 | A | | 4/1930 | Haskell |
| 1,852,716 | A | | 4/1932 | Grinnell |
| 1,852,717 | A | | 4/1932 | Grinnell et al. |
| 1,992,424 | A | | 2/1935 | Halliburton |
| 2,077,912 | A | | 4/1937 | Van Voorhis |
| 2,179,226 | A | | 11/1939 | Bryan |
| 2,227,538 | A | | 1/1941 | Dorton |
| 2,917,004 | A | | 12/1959 | Davis et al. |
| 3,016,844 | A | * | 1/1962 | Vincent ..... 417/113 |
| 3,065,793 | A | | 11/1962 | Page |
| 3,090,316 | A | | 5/1963 | Montgomery |
| 3,106,170 | A | | 10/1963 | Gray et al. |
| 3,160,113 | A | | 12/1964 | Meyers |
| 3,182,726 | A | | 5/1965 | Stone, Jr. |
| 3,190,357 | A | | 6/1965 | Kirk |
| 3,215,087 | A | | 11/1965 | McLeod, Jr. |

(Continued)

FOREIGN PATENT DOCUMENTS

| | | |
|---|---|---|
| GB | 222536 | 9/1924 |

(Continued)

OTHER PUBLICATIONS

The Composite Catalog of Oil Field and Pipe Line Equipment, No. Thirteen, 1942 Edition; p. 1642; The Gulf Publishing Co., USA.

(Continued)

*Primary Examiner*—Giovanna C Wright
(74) *Attorney, Agent, or Firm*—Jack E. Ebel

(57) ABSTRACT

Apparatus, assembly and process for allowing gas lift operations to be conducted along a relatively long perforated interval below a packer in a subterranean well. An elongated segregation member is lowered into locking engagement with a bypass mandrel secured to a tubing string above the packer. This segregation member is configured and dimensioned to define two fluid flow paths. Fluid produced into the well from the subterranean region is conveyed to the surface via the second flow path and can be assisted by gas injected into the first flow path via retrievable gas lift valves in the tubing string above and below the packer. Pressurized gas is conveyed via the first flow path to these retrievable gas lift valves.

16 Claims, 4 Drawing Sheets

U.S. PATENT DOCUMENTS

| | | | | |
|---|---|---|---|---|
| 3,268,004 | A | | 8/1966 | Kiel |
| 3,302,581 | A | | 2/1967 | Burch |
| 3,427,651 | A | | 2/1969 | Bielstein et al. |
| 3,427,653 | A | | 2/1969 | Jensen |
| 3,580,332 | A | | 5/1971 | Dean et al. |
| 3,580,336 | A | | 5/1971 | Meldau |
| 3,617,152 | A | | 11/1971 | Cummings |
| 3,625,288 | A | | 12/1971 | Roeder |
| 3,642,070 | A | | 2/1972 | Taylor et al. |
| 3,654,949 | A | | 4/1972 | McMurry |
| 3,659,961 | A | | 5/1972 | Lamb et al. |
| 3,718,407 | A | | 2/1973 | Newbrough |
| 3,735,815 | A | | 5/1973 | Myers |
| 3,746,089 | A | | 7/1973 | Vencil |
| 3,750,753 | A | | 8/1973 | Bernard |
| 3,754,597 | A | | 8/1973 | Garrett |
| 3,784,325 | A | | 1/1974 | Coanda et al. |
| 3,814,545 | A | | 6/1974 | Waters |
| 3,844,352 | A | | 10/1974 | Garrett |
| 3,851,997 | A | | 12/1974 | Douglas |
| 3,873,238 | A | | 3/1975 | Elfarr |
| 3,887,008 | A | | 6/1975 | Canfield |
| 4,294,313 | A | | 10/1981 | Schwegman |
| 4,545,731 | A | | 10/1985 | Canalizo et al. |
| 4,682,656 | A | | 7/1987 | Waters |
| 4,708,595 | A | | 11/1987 | Maloney et al. |
| 5,022,427 | A | | 6/1991 | Churchman et al. |
| 5,048,610 | A | | 9/1991 | Ross et al. |
| 5,113,939 | A | | 5/1992 | Ross et al. |
| 5,257,665 | A | * | 11/1993 | Watkins ..... 166/372 |
| 5,329,999 | A | | 7/1994 | White et al. |
| 5,425,425 | A | | 6/1995 | Bankston et al. |
| 5,501,279 | A | | 3/1996 | Garg et al. |
| 5,875,852 | A | | 3/1999 | Floyd et al. |
| 6,082,452 | A | | 7/2000 | Shaw et al. |
| 7,147,059 | B2 | | 12/2006 | Hirsch et al. |
| 7,367,401 | B2 | | 5/2008 | Moffett et al. |
| 2006/0076140 | A1 | | 4/2006 | Rouen |
| 2006/0113082 | A1 | | 6/2006 | Moffett et al. |

FOREIGN PATENT DOCUMENTS

| | | |
|---|---|---|
| GB | 534850 | 3/1941 |

OTHER PUBLICATIONS

The Composite Catalog of Oil Field and Pipe Line Equipment, 18th Edition (1951), vol. 1; p. 1056; The Gulf Publishing Co., USA.

The Composite Catalog of Oil Field and Pipe Line Equipment, 18th Edition (1951), vol. 2; pp. 3971 and 3986; The Gulf Publishing Co., USA.

The Composite Catalog of Oil Field and Pipe Line Equipment, 19th Edition (1952-1953), vol. 2; pp. 4047 and 4050; The Gulf Publishing Co., USA.

The Composite Catalog of Oil Field Equipment and Services, 23rd Revision (1958-59), vol. 1; pp. 1090-1091; The Gulf Publishing Co., USA.

The Composite Catalog of Oil Field Equipment and Services, 24th Revision (1960-61), vol. 3; p. 4294-B; The Gulf Publishing Co., USA.

Composite Catalog of Oil Field Equipment and Services, 27th Revision, 1966-67, vol. 2; p. 3320; The Gulf Publishing Co., USA.

* cited by examiner

APPARATUS, ASSEMBLY AND PROCESS FOR INJECTING FLUID INTO A SUBTERRANEAN WELL

BACKGROUND OF THE INVENTION

1. Field of the Invention

The present invention relates to an apparatus, assembly and process for permitting fluid to be conveyed into a subterranean well via retrievable equipment positioned in tubing below a packer, and more particularly, to such apparatus, assembly and process for permitting gas lift to be conducted in a subterranean well below a packer wherein wireline retrievable gas lift valves are employed below the packer.

2. Description of related Art

To produce fluids, such as hydrocarbons, from a subterranean formation, a well is drilled from the surface to a depth sufficient to capture the fluids of interest. The well is typically completed by cementing a string of tubulars, i.e. a casing string, in the well and establishing fluid communication between the well and the formation(s) and/or zone(s) of interest by forming perforations through the casing and into the formation(s) and/or zone(s) of interest. Such perforations can be formed by any suitable means, such as by conventional perforating guns. Thereafter, production tubing is positioned within the well and the annulus between the production tubing and casing is sealed typically by means of a packer assembly. Fluids, such as oil, gas and/or water, are then produced from the formation(s) and/or zone(s) of interest into the well via the perforations in the casing and to the surface via production tubing for transportation and/or processing.

While the formation or reservoir pressure is often initially sufficient to force produced fluids to the surface after completion of the well, some form of artificial lift, for example rod pumps, electrical submersible pumps, or gas lift, usually becomes necessary to assist in producing fluids from the well when the reservoir pressure becomes insufficient to produce fluids to the surface. In its simplest form, gas lift consists of injecting gas from the surface under pressure into the annulus between the casing and production tubing in a well. This injected gas is isolated from the perforations in the casing by means of the packer assembly that seals the casing/tubing annulus above the perforations. The production tubing above the packer is equipped with metering valves that inject the pressurized gas from the casing/tubing annulus into the tubing in an upward flow. These metering valves are installed in mandrels that are included in the tubing. This injected gas lightens the produced fluid present in the production tubing and the upward flow thereof assists in producing fluid upwardly toward the surface wellhead. The number and spacing of gas lift valves used in the production tubing above the packer is calculated to produce fluids to the surface in light of well data, the packer depth and desired production rates. It is preferred to use retrievable metering valves that can be removed from the well by means of a wireline unit and specially designed tools thereby eliminating the need and expense of pulling the production tubing from the well to repair and/or replace metering valves.

Wells are being increasingly completed with long perforated intervals of casing below the packer, for example up to 1,500 feet or more, to maximize production of fluids from subterranean formation(s) and/or zone(s) of interest. Such wells can be produced by conventional gas lift using metering valves above the packer for so long as the reservoir pressure is sufficient enough to convey produced fluids above the first gas lift valve positioned above the packer assembly. However, the pressure in many wells is or becomes insufficient to permit the well to be produced by conventional gas lift techniques and equipment.

A specialized packer has been developed to install gas metering valves in tubing below the packer so as to extend gas lift operations along the perforated interval below the packer. The tubing is secured to the packer and requires that the packer be released and all of the tubing and the packer be removed from the well to repair or replace the metering valves that are positioned below the packer. This packer and the procedure for removing metering valves are expensive and result in lost production of reservoir fluids.

Thus, a need exists for apparatus, assemblies and processes to provide for gas lift in tubing below the packer assembly in a well so as to provide production from a perforated interval. A further need exists for such apparatus, assemblies and processes for performing gas lift operations below a packer in a well which permit gas lift metering valves to be retrievable by wireline.

SUMMARY OF THE INVENTION

To achieve the foregoing and other objects, and in accordance with the purposes of the present invention, as embodied and broadly described herein, one characterization of the present invention may comprise an apparatus having an elongated member including an upper section, an intermediate section dimensioned to extend through a packer deployed in a subterranean well and a lower section. The elongated member has a generally axial bore extending through the lower section and the intermediate section and into the upper section and in fluid communication with at least one opening extending through a side wall of said upper section.

In another characterization of the present invention, an assembly is provided which has first and second sections of tubing string and a segregation member. A first section of a tubing string extends from the surface of the earth into a subterranean well bore and has a packer secured to the lower end thereof. The first section has a generally axial bore therethrough and one or more openings through the wall thereof. A second section of the tubing string is secured to the packer and extends into the subterranean well bore below the packer. The second section has a generally axial bore therethrough and one or more openings through the wall thereof. A segregation member is releasably secured to the first section and extends through the packer and into the second section of the tubing string. A segregation member has a bore extending through a portion thereof which is in fluid communication with the one or openings through the wall of the first section so as to define a flow path from the surface of the earth through a first annulus defined between the first section and the well bore, the one or more openings, and the bore in the segregation member.

In yet another characterization of the present invention, a subterranean well is provided comprising a tubing string positioned within a casing in a subterranean well and having a packer secured intermediate the length thereof and sealingly engaging the casing. At least one piece of equipment is secured to the tubing string below the packer and is capable of being retrieved on wireline that is conveyed within the tubing string.

In a further characterization of the present invention, a process is provided for equipping a subterranean well for a gas lift operation. A tubing string having a packer secured intermediate the length thereof is positioned into a subterranean well. The packer sealingly engages casing secured in the well thereby defining a first annulus between the tubing string and casing above the packer and a second annulus between the tubing string and casing below the packer. The tubing string contains retrievable gas lift valves both above and below the packer and contains at least one opening through the wall of the tubing above the packer and at least one opening through the wall of the tubing sting below the packer. A device is positioned within the tubing string such that the device extends above and below said packer and defines a first fluid flow path from the first annulus to the interior of the tubing string below the packer and a second flow path from the second annulus to the interior of the tubing string above the packer.

In a still further characterization of the present invention, a process is provided for conducting a gas lift operation in a subterranean well. A gas is injected under pressure into the annulus defined between a tubing string positioned in a subterranean well and casing secured in the well, through an internal flow path defined though a packer assembly secured to said tubing string intermediate the length thereof, and into the interior of said tubing string below the packer assembly. This gas is initially injected into the interior of the tubing string above the packer assembly via at least one first gas lift valve and subsequently is injected into the annulus defined between the tubing string and casing below the packer assembly via at least one second gas lift valve. Fluid is produced from a subterranean region penetrated by the well via the annulus between the tubing string below the packer assembly and the casing, an internal annular flow path through the packer assembly defined between said internal flow path and said packer assembly, and the interior of the tubing string above the packer assembly.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENTS

Figure 1:
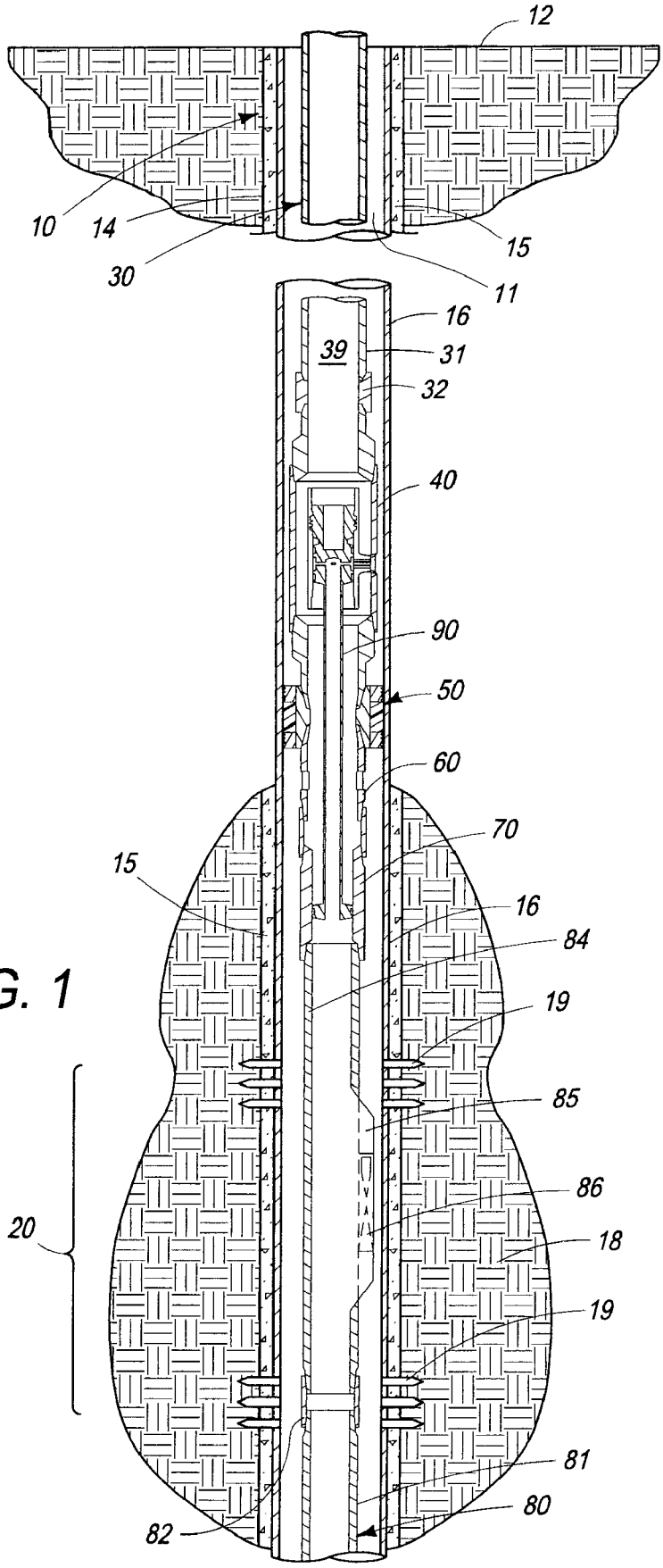
FIG. 1 is a partially cutaway, cross sectional view of a subterranean well equipped with the assembly of the present invention.

Referring to FIG. 1, a well is indicated generally at 10 and has a well bore 14 which extends from the surface of the earth 12 to a subterranean depth sufficient to penetrate subterranean zones of interest. The well is equipped with generally tubular casing 16 which is conventionally made up of lengths of tubular casing secured together by any suitable means, such as mating screw threads. The casing 16 is secured to the well bore 14 by a sheath of cement 15 which is circulated into place as is evident to a skilled artisan. The well is thereafter placed in fluid communication with subterranean region 18 by means of at least one set of perforations 19 which is formed by any conventional means, such as by one or more perforating gun lowered to the desired depth within the well and ignited. As utilized throughout this description, the term "subterranean region" denotes one or more layers, strata, zones, horizons, reservoirs, or combinations thereof so long as fluids produced therefrom can be commingled for production from the well. The entire interval over which perforations exist in the well is termed the perforated interval 20.

Figure 2:
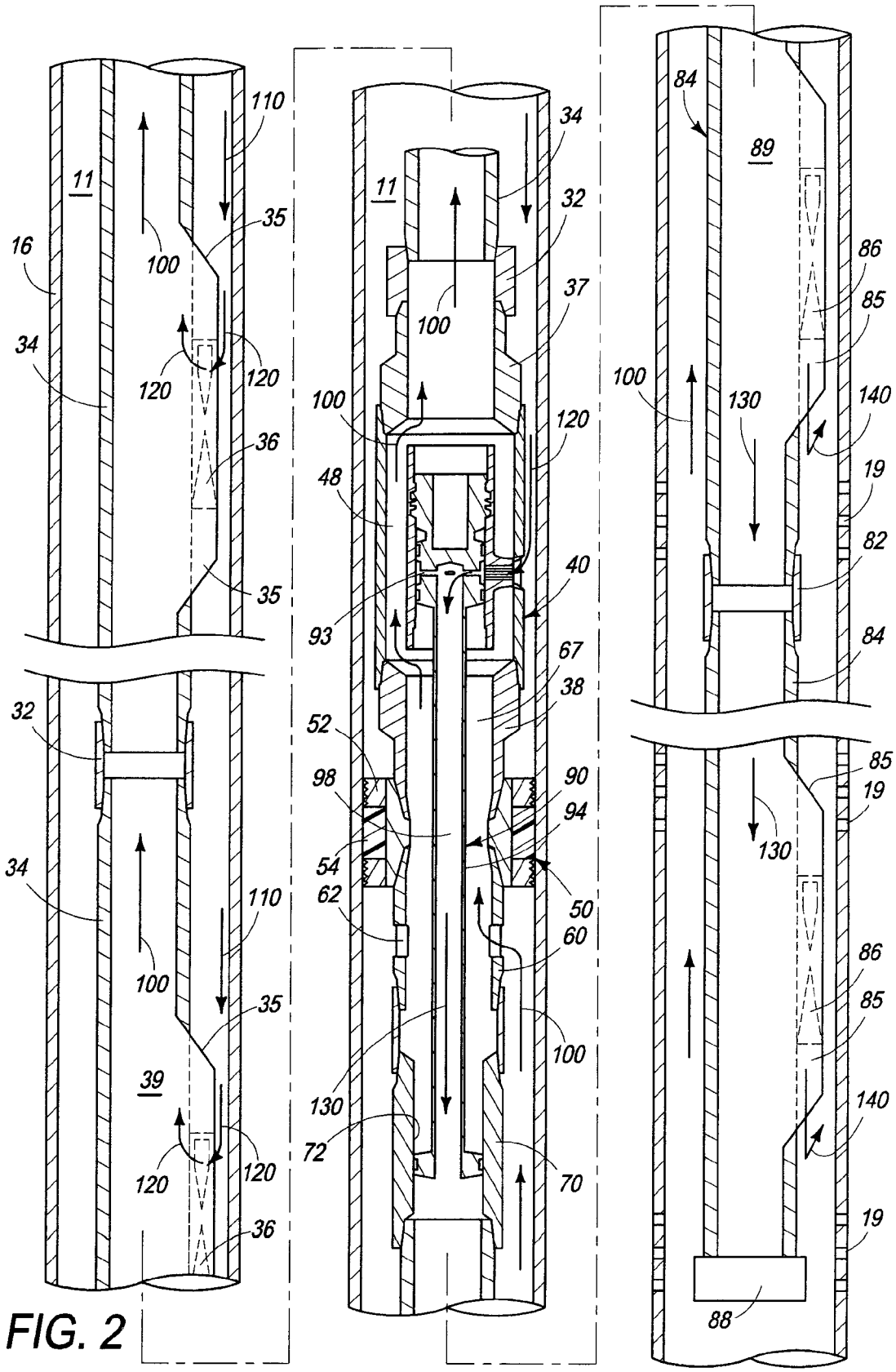
FIG. 2 is a partially cutaway, cross sectional view of a subterranean well equipped with the assembly of the present invention illustrating fluid flow in accordance with the gas lift process of the present invention.
Figure 3:
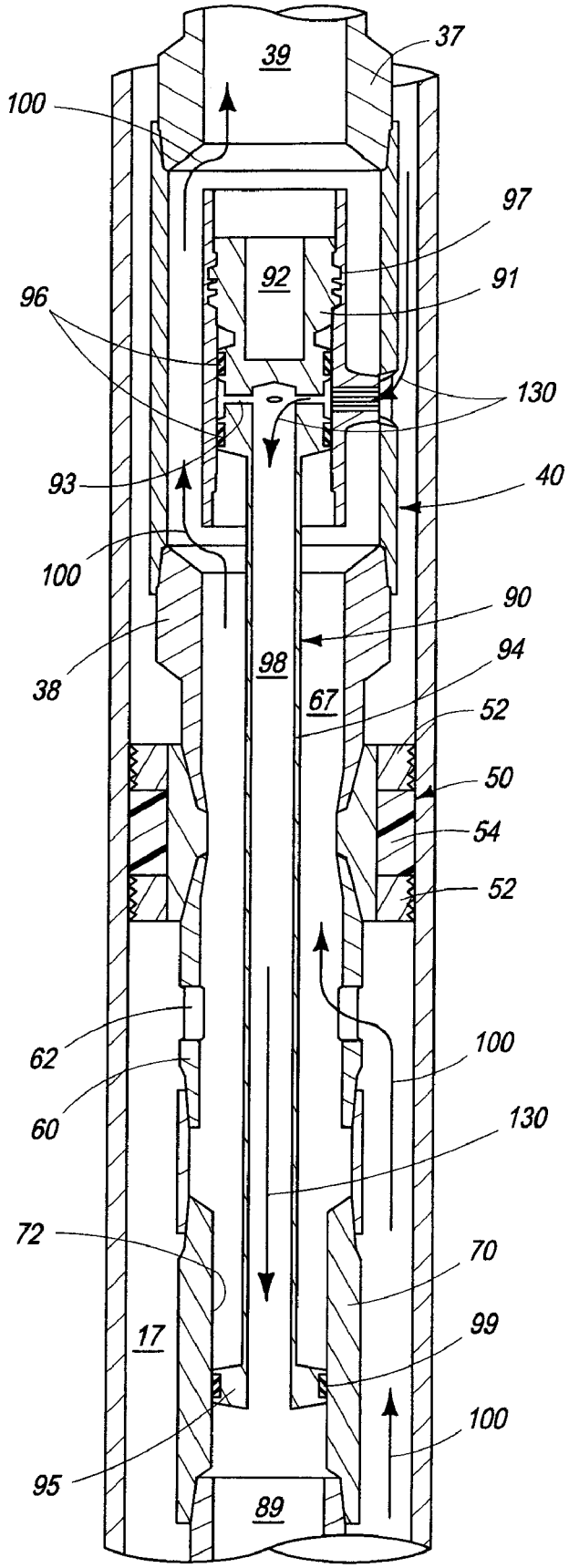
FIG. 3 is a partially cutaway, cross sectional view of a portion of the assembly of the present invention.
Figure 4:
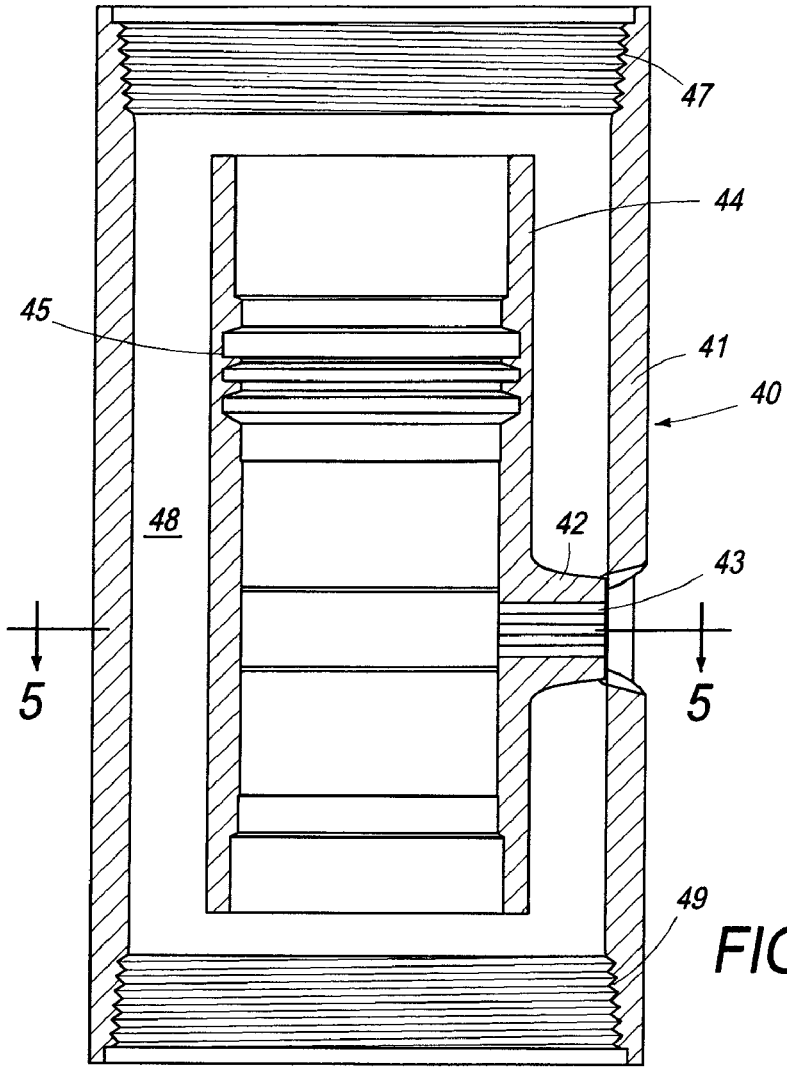
FIG. 4 is a cross sectional view of the by-pass mandrel of the present invention.
Figure 5:
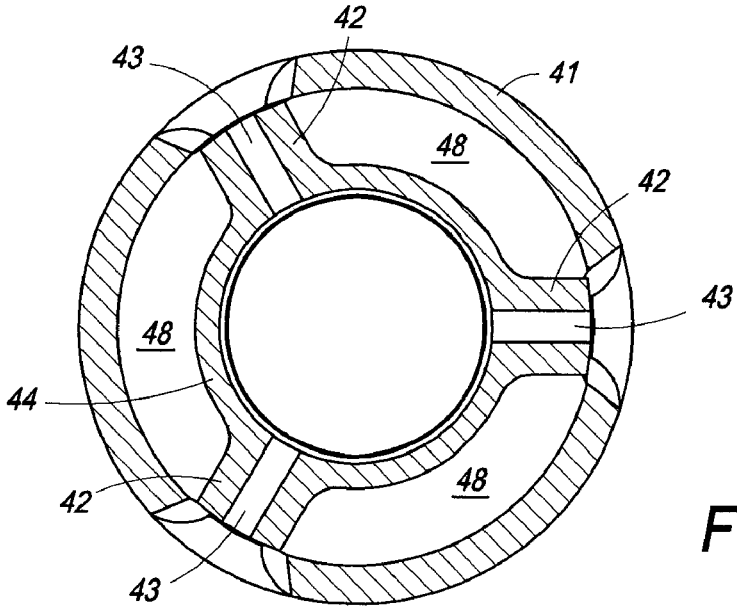
FIG. 5 is a cross sectional view taken along line 5-5 of FIG. 4.

In accordance with the present invention, a tubing string 30 is positioned in the well and can be made up of individual joints of tubing 31 secured together by collars 32 as illustrated in FIGS. 1-3 by any suitable means, such as screw threads. Tubing string 30 can include at least one mandrel 34 having a side pocket 35 into which a retrievable apparatus or piece of equipment, for example a gas lift valve 36, is releasably secured. A bypass mandrel 40 is secured to an adaptor 37 which in turn is secured to the lower end of the tubing string as positioned in the well 30 (mandrel 34 as illustrated in FIG. 2) by any suitable means, such as by screw threads. The other end of bypass mandrel 40 is secured to adaptor 38 that in turn is secured to packer assembly 50. Packer assembly 50, flow crossover sleeve 60 and generally tubular seal bore nipple 70 are secured together in series by any suitable means, such as by screw threads, and a lower tubing string 80 is secured to the other end of the seal bore nipple by any suitable means, such as by screw threads. Cross over sleeve 60 has one or more ports or openings 62 along the length thereof. Lower tubing string 80 can be made up of individual joints of tubing 81 secured together by collars 82 as illustrated. Lower tubing string 80 can include at least one mandrel 84 having a side pocket 85 into which a retrievable apparatus or piece of equipment, for example a metered gas lift valve 86, is releasably secured. The lower end of lower tubing string 80 is plugged by any suitable means, such as cap 88. The number and spacing of mandrels 34 and 84 deployed in tubing string 30 and lower tubing string 80, respectively, are calculated to provide for maximum gas lift capacity.

The bypass mandrel 40 (FIGS. 2-5) has an outer, generally tubular housing 41 and an inner, generally tubular member 44 which are connected together by one or more spokes or arms 42. Housing 41 and inner tubular member 44 are preferably axially aligned. Housing 41, inner member 44 and one or more spokes 42 can be integrally formed or secured together by any suitable means, such as by welds. Each spoke 42 has one or more ports 43 that provide for fluid communication between the exterior and interior of the bypass mandrel as hereinafter described. The inner diameter of inner tubular member 44 of the bypass mandrel is sized to permit passage of retrieval tools that can be lowered through tubing strings 30 and 80 for retrieval of equipment, such as gas lift valves 86, from mandrels 84 that are positioned below packer 50 in a manner as hereinafter described. The inner surface of one end of the inner tubular member 44 is provided with a cross sectional profile 45. Each end of housing 41 is provided with any suitable means for mating with other components of the assembly of the present invention, such as screw threads.

The assembly described above can be assembled as the components are being run into the well. Once the assembly and associated tubing strings 30 and 80 are positioned so that packer assembly 50 is above and gas lift valves 86 are appropriately positioned in relation to the perforated interval from which fluids from subterranean region 18 are to be produced, the slips 52 and generally annular seal 54 of packer assembly 50 can be hydraulically and/or mechanically expanded into sealing engagement with casing 16 so as to form a fluid tight seal across annulus formed between packer assembly 50 and casing 16. In this manner, the annulus 11 formed between casing string 16 and the tubing string 30 and associated components above the packer assembly 50 is segregated from the annulus 17 formed between the casing 16 and the lower tubing string 80 and associated components below the packer assembly.

In accordance with the present invention, a segregation member 90 is thereafter conveyed into tubing 30 from the surface by any suitable means, such as by a wireline. Segregation member 90 functions to isolate separate fluid flow paths through the assembly of the present invention and has an upper end 91, a generally tubular lower end 95 connected together by a generally tubular intermediate portion 94 of reduced diameter. Segregation member 90 can be integrally formed or formed of multiple portions secured together by any suitable means, for example by welds or threaded connections. Generally tubular portions 94 and 95 define an axial bore 98 therethrough that extends into one end of upper portion 91. Upper portion 91 is provided with one or more radial openings 93 that can have any suitable configuration, for example a slot or port, and that intersect with bore 98 and extend outwardly to the periphery of upper end 91. The other end of upper end 91 is provided with an axially extending bore 92 to allow engagement of segregation member 90 by a fishing tool for deployment and removal from a well. The outer peripheral surface of upper end 91 is provided with a cross sectional profile 97 that corresponds to cross sectional profile 45 of bypass mandrel 40. The upper end has generally annular seals 96 which are spaced apart to provide a fluid tight seal for radial ports or openings 93 as hereinafter described. Annular seals 99 are provided around the exterior of lower end 95. The length of segregation member 90 can vary depending upon the length of packer 50, for example about 5 to about 8 feet. The diameters of the various components of segregation member 90 are selected depending upon the pressure and rate of gas being injected and fluid produced through the assembly of the present invention.

Segregation member 90 is conveyed through tubing 30 until the profile 97 on the outer peripheral surface of upper end 91 thereof engages profile 45 on the inner surface of one end of inner tubular member 44 and releasably locks segregation member 90 into engagement with bypass mandrel 40. In this positioned as illustrated in FIGS. 1-3, radial ports or openings 93 in upper portion 91 are aligned with ports 43 of bypass mandrel 40, intermediate portion 94 of segregation member 90 extends through packer assembly 50 and annular seals 99 on the lower end 95 of segregation member 90 engage the inner surface 72 of seal bore nipple 70 so as to provide a fluid tight seal.

Once the segregation member 90 is secured within bypass mandrel 40, the wireline is released from segregation member 90 and withdrawn to the surface and the well is ready for production. In operation, fluid is produced from subterranean region 18 through perforations 19 in the perforated interval 20 and upwardly as indicated by arrows 100 through annulus 17, ports 62, annulus 67, annulus 48 and bore 39 to the surface. If fluid is not capable of being produced to the surface by the pressure of the subterranean region, gas can be injected under pressure into annulus 11 between upper tubing string 30 and casing 16 as indicated by arrows 110 (FIG. 2). Initially gas is injected into produced fluid contained in bore 39 of tubing string 30 above packer assembly 50 by means of gas lift valves 36 as indicated by arrows 120 to assist in production of fluid in tubing 30. During this phase of the operation, gas is sequentially injected through gas lift valves 36 beginning with the uppermost gas lift valve 36 in tubing string 30. Once the fluid pressure in the tubing string 30 has been sufficiently lowered by the injected gas, pressurized gas is conveyed though annulus 11, aligned ports 93 and 43 and bores 98 and 89 as indicated by arrows 130 and is injected into produced fluid contained in annulus 17 by means of gas lift valves 86 as indicated by arrows 140. During this phase of the gas lift operation, gas is sequentially injected through gas lift valves 86 beginning with the uppermost gas lift valve 86 in tubing string 80. In this manner, pressurized gas is injected into produced fluid contained in the annulus between the lower tubing string below the packer to assist in production of produced fluids to the surface.

When it is desired to remove gas lift valves 86 for repair or replacement, a wireline with a retrieving tool at the lower end thereof can be run into tubing string 30 so as to latch onto upper portion 91 of segregation member 90 via bore 92. The wireline, retrieving tool and segregation member 90 are then removed from the well and wireline is then run into the well to retrieve the desired gas lift valves 86 in a manner evident to a skilled artisan. Thereafter, refurbished and/or new gas lift valves are secured in side pockets 85 of mandrels 84 via wireline and segregation member 90 is thereafter conveyed via tubing string 30 and locked in engagement with bypass mandrel 40.

The following example demonstrates the practice and utility of the present invention, but is not to be construed as limiting the scope thereof.

EXAMPLE

A workover rig is moved onto a well, blow out prevention equipment is installed and the existing 2.875 inch outside diameter ("OD") production tubing is removed from the 5.5 inch OD production casing in the well. The well is cleaned of any debris by running a tubing bailer on the 2.875 inch tubing to the total depth of the well of 9,000 feet. The tubing and bailer are removed from the well. The integrity of the casing above the top of the perforations in the well is determined by running a 5.5 inch OD packer on the 2.875 inch tubing to a depth of 7,500 feet. The packer is mechanically set and the annulus between the 2.875 inch tubing and the 5.5 inch casing above the packer is filled with completion fluid. The blow out prevention equipment is closed at the surface and the fluid in the annulus is pressurized to 1500 pounds per square inch to determine casing integrity. Once casing integrity has been established, the packer is released and the tubing and the packer are removed from the 5.5 inch casing.

The below packer gas lift assembly is then inserted into the 5.5 inch casing. The assembly consists of the following components starting from the bottom. The assembly consists of a 2.875 inch tubing bull plug, 1,500 feet of 2.875 inch OD tubing with three 2.875 inch by 4.5 inch OD side pocket gas lift mandrels ported for annular flow spaced approximately 400 to 500 feet apart. Each gas lift mandrel is eccentric in design with the end fittings having 2.875 inch OD so as to permit mating by screw threads with the 2.875 inch OD tubing and the body of the mandrel that defines the side pocket has a 4.5 inch OD. The side pocket mandrels are each equipped with a wireline retrievable gas lift valve designed to operate with the predetermined gas lift injection volume and pressure. This portion of the assembly is then connected to a 2.875 inch OD by 2.25 inch inner diameter ("ID") by 1.5 foot long seal nipple, a 2.875 inch OD by 1 foot long ported sub and a 5.5 inch OD casing packer. On top of the packer a 4.5 inch OD by 2.313 inch ID bypass mandrel is installed. Above the bypass mandrel, 7,500 feet of 2.875 inch OD tubing including three 2.875 inch by 4.5 inch side pocket gas lift mandrels ported for tubing flow are installed. Each gas lift mandrel is eccentric in design with the end fittings having 2.875 inch OD so as to permit mating by screw threads with the 2.875 inch OD tubing and the body of the mandrel that defines the side pocket has a 4.5 inch OD. The placement of the side pocket mandrels are based on the well pressure, expected production rate, design gas lift injection rate and pressure. A wireline retrievable gas lift valve which is designed to operate with the predetermined gas lift pressure and volume is installed in each side pocket mandrel. When the entire gas lift and tubing assembly is installed in the 5.5 inch OD production casing in the well, the gas lift assembly below the packer is placed adjacent to the perforated portion of the wellbore between the depths of 7,500 to 9,000 feet. The packer is then mechanically set approximately 50 feet above the top of the upper most perforation in the production casing. The blow out prevention equipment is then removed from the well, the 2.875 inch OD tubing is connected to the 5.5 inch OD casing wellhead, the wellhead valves are installed and the workover rig is removed from the well.

A slickline (single element wireline) truck is moved in and rigged up on the well with a 2.875 inch OD lubricator installed on the wellhead. A segregation member having a 2.313 inch OD upper end with two sets of 2.313 inch OD seals located on either side of ports connected to a 1 inch OD intermediate portion approximately 12 feet long which then connects to a 2.25 inch OD lower end is attached to wireline running tools and installed into the lubricator on the wellhead. The valves on the wellhead are then opened and the segregation member is lowered into the 2.875 inch OD tubing in the well on the wireline to the bypass mandrel. The 2.25 inch OD lower seal of the segregation member is inserted through the bypass mandrel, through the center of the 5.5 inch OD packer and the ported sub into the 2.25 inch ID seal bore nipple. A profile on the 2.313 inch OD upper end of the segregation member is located and locked into a 2.313 inch ID profile in the bypass mandrel with the two sets of 2.313 inch OD seals spaced on either side of the ports in the bypass mandrel. The wireline setting tools are released from the segregation member and are then removed from the well by wireline. The lubricator and wireline truck are removed from the well. A high pressure gas line is connected to the annulus defined between the tubing and casing and the annulus is allowed to pressure up to the predetermined maximum kick off pressure. The tubing is connected to the appropriate production facilities and once the casing pressure has reached the predetermined level, the tubing is opened for flow to the production facilities. The well will go through a normal gas lift unloading sequence from the gas lift valves above the packer and will transfer downhole to the gas lift valves below the packer until injection reaches the lowest most operating gas lift valve.

If the producing character of the well changes or a problem develops which would necessitate a change in the design or repair of the gas lift valves, a wireline truck is moved back on the well and the 2.875 inch OD lubricator is installed on the wellhead. Retrieving tools are attached to the wireline and are installed into the lubricator. The valves on the wellhead are opened and the retrieving tools are lowered into the 2.875 inch OD tubing on wireline to the upper end of the segregation member located in the bypass mandrel located at a depth of approximately 7,500 feet. The upper end of the segregation member is engaged by the wireline retrieving tools and the segregation member is removed from the well by wireline. A gas lift valve retrieving tool along with a side pocket kick over tool is then attached to the wireline and lowered into the 2.875 inch OD tubing, through the bypass mandrel to the depth of the gas lift valve which needs to be repaired or replaced. The side pocket kick over tool is activated, the gas lift valve is engaged with the retrieving tool and the valve is released from the side pocket mandrel and removed from the wellbore by wireline. The gas lift valve retrieving tool is removed from the wireline and a gas lift valve running tool is installed along with the side pocket kick over tool. The redesigned or repaired gas lift valve is attached to the gas lift valve running tool and is inserted into the 2.875 inch OD tubing and run through the bypass mandrel on wireline to the depth of the side pocket gas lift mandrel into which it is to be installed. At the proper depth, the side pocket kick over tool is activated and the gas lift valve is inserted and releasably secured into the side pocket mandrel. The wireline gas lift valve setting tool is released from the gas lift valve and the wireline and tools are removed from the wellbore. The side pocket kick over tool and the gas lift valve setting tool are removed from the wireline and the cross over seal assembly running tool is connected to the wireline. The upper end of the segregation member is then attached to the segregation member running tool and inserted into the 2.875 inch OD tubing on wireline. The lower 2.25 inch OD seal is inserted through the bypass mandrel, the 5.5 inch OD packer, the ported sub, and into the 2.25 inch ID seal bore nipple. The profile on the 2.313 inch OD upper end of the segregation member is inserted and locked into the 2.313 inch ID profile in the bypass mandrel with the two sets of 2.313 inch OD seals located either side of the ports in the bypass mandrel. The setting tool is released from the upper end of the segregation member and the setting tool is removed from the wellbore by wireline. The wireline truck and lubricator is removed from the well, high pressure gas injection is initiated on the annulus defined between the tubing and the casing, the tubing is opened to the production facilities and the gas lift unloading sequence through the gas lift valves is initiated until the gas injection reaches the operating gas lift valve.

By including gas lift valves and associated mandrels in tubing that is supported on a packer assembly, the apparatus and process of the present invention permit long perforated intervals to be produced by gas lift. The tubing employed below the packer in accordance with the present invention can be up to 15,000 feet or more. Further, the apparatus and process of the present invention allow retrievable apparatus and equipment, for example gas lift valves, to be used over long perforated intervals below the packer assembly. In this manner, long perforated intervals can be effectively produced by gas lift and apparatus and equipment, such as gas lift valves, can be retrieved for repair or replacement without pulling the production tubing from the well.

As noted above, the present invention can be deployed and practiced using retrievable equipment other than gas lift valves 36 and/or 86. For example, flow control valves, water flood regulators, chokes, orifices, pressure gauges, temperature gauges, measurement devices or combinations thereof can be employed in lieu of gas lift valves 36 or 86 in one or all of the mandrels 34 or 84 deployed in casing strings 30 and 80, respectively. Accordingly, operations such as chemical injection, foam injection to unload water from a well, fresh water injection to lower salt concentration of connate water, injection of scale inhibitor, can be preformed using the apparatus, assembly and process of the present invention.

Although casing 16 is illustrated as being one continuous tubular having a substantially uniform diameter along the length thereof, casing 16 can be made up of several intervals of tubing having differing diameters as will be evident to a skilled artisan. For example, surface casing can extend from the surface of the earth to a given depth, intermediate casing having a diameter less than that of the surface casing can extend from generally the depth at which the surface casing ends to another given depth, and a liner having a diameter less than that of the intermediate casing can extend from generally the depth at which the intermediate casing ends to subterranean region of interest. The apparatus, assembly and process of the present invention can be used with various casing configurations as will be evident to a skilled artisan. Further, components of the assembly of the present invention can extend into one or more sections of casing of a well. For example, where a casing configuration having surface casing, intermediate casing and a liner is utilized, the elastomeric seal 54 and slips 55 of the packer assembly 50 can be set in intermediate casing while the lower tubing string 80 extends into a liner.

While the foregoing preferred embodiments of the invention have been described and shown, it is understood that the alternatives and modifications, such as those suggested and others, may be made thereto and fall within the scope of the invention.

We claim:

1. An assembly comprising:

a first section of a tubing string extending from the surface of the earth into a subterranean well bore and having a packer secured to the lower end thereof, said first section having a generally axial bore therethrough and at least one opening through the wall thereof;

a second section of said tubing string secured to said packer and extending into said subterranean well bore below said packer, said second section having a generally axial bore therethrough, containing at least one mandrel and having at least one opening through the wall thereof; and a segregation member releasably secured to said first section and extending through the packer and into the second section of said tubing string, said segregation member having a bore extending through a portion thereof which is in fluid communication with said at least one opening through the wall of said first section so as to define a flow path from the surface of the earth through a first annulus defined between the first section and the well bore, said at least one opening through the wall of the first section, and the bore in said segregation member.

2. The assembly of claim 1 wherein said segregation member is retrievable from said first section by means of a wireline.

3. The assembly of claim 1 wherein said first section of tubing string includes a bypass mandrel and said at least one opening through the wall of the first section is through the wall of said bypass mandrel and said segregation member is releasably secured to said bypass mandrel.

4. The assembly of claim 3 wherein said first section of tubing string includes a bypass mandrel having an outer housing and an inner member defining an annulus therebetween through which fluid can pass.

5. The assembly of claim 4 wherein the inner member is generally tubular and has an axial bore therethrough that is sized to permit passage of wireline conveyed tools to the second section of tubing string.

6. The assembly of claim 1 wherein said second section of tubing includes a cross over sleeve and said at least one opening through the wall of the second section is through a wall of said cross over sleeve.

7. The assembly of claim 1 further comprising:

apparatus releasably secured to each of said at least one mandrel.

8. The assembly of claim 7 wherein said apparatus is selected from the group consisting of gas lift valves, flow control valves, water flood regulators, chokes, orifices, pressure gauges, temperature gauges, measurement devices or combinations thereof.

9. A subterranean well comprising:

one tubing string positioned within casing in a subterranean well, extending from the surface of the earth to a subterranean region and having a packer secured intermediate the length thereof and sealingly engaging said casing; and at least one gas lift valve releasably secured to said tubing string below said packer, capable of permitting injection of pressurized gas into produced fluid in an annulus between said one tubing string and the casing to assist in conveying said produced fluid through a portion of said one tubing string and capable of being retrieved on wireline that is conveyed within said tubing string.

10. The subterranean well of claim 9 wherein said at least one gas lift valve is a plurality of gas lift valves.

11. A process for equipping a subterranean well comprising:

positioning a tubing string having a packer secured intermediate the length thereof into a subterranean well, said packer sealingly engaging casing secured in the well thereby defining a first annulus between the tubing string and casing above the packer and a second annulus between the tubing string and casing below the packer, said tubing string containing retrievable equipment both above and below the packer and containing at least one opening through the wall of the tubing above the packer and at least one opening through the wall of the tubing string below the packer; and positioning a device within the tubing string such that the device extends above and below said packer and defines a first fluid flow path from the first annulus to the interior of the tubing string below the packer and a second flow path from the second annulus to the interior of the tubing string above the packer.

12. The process of claim 11 wherein said retrievable equipment is a gas lift valve.

13. The process of claim 12 further comprising:

removing said device from said tubing string; and retrieving at least one of said retrievable gas lift valves below the packer from the well.

14. A process for conveying fluid into a subterranean well comprising:

injecting a fluid under pressure into the annulus defined between a tubing string positioned in a subterranean well and casing secured in said well, through an internal flow path defined through a packer assembly secured to said tubing string intermediate the length thereof, and into the interior of said tubing string below said packer assembly, said fluid being initially injected into the interior of the tubing string above the packer assembly via at least one first flow control apparatus and subsequently being injected into the annulus defined between the tubing string and casing below the packer assembly via at least one second flow control apparatus; and producing fluid from a subterranean region penetrated by the well via the annulus between the tubing string below the packer assembly and the casing, an internal annular flow path through the packer assembly defined between said internal flow path and said packer assembly, and the interior of the tubing string above the packer assembly.

15. The process of claim 14 wherein said at least one first flow control apparatus and said at least one second flow control apparatus are gas lift valves.

16. The process of claim 15 further comprising:

retrieving said at least one second flow control apparatus from the well by means of wireline lowered through the well from the surface of the earth.

* * * * *